US005987948A

United States Patent [19]

Neushütz et al.

[11] Patent Number: 5,987,948

[45] Date of Patent: Nov. 23, 1999

[54] PRESETTING FOR COLD-ROLL REVERSAL STAND

[75] Inventors: Eberhard Neushütz, Ratingen; Gert Mücke, Hilden; Roger Lathe, Remscheid; Frank Gorgels, Aachen, all of Germany

[73] Assignee: Betriebsforschungsinstitut, VDEH-Institut fur Angewandte Forschung GmbH, Dusseldorf, Germany

[21] Appl. No.: 08/868,917

[22] Filed: Jun. 4, 1997

[30] Foreign Application Priority Data

Jun. 7, 1996 [DE] Germany ..... 196 22 825

[51] Int. Cl.[6] ..... B21B 37/24

[52] U.S. Cl. ..... 72/7.1; 72/365.2

[58] Field of Search ..... 72/7.1, 7.2, 7.4, 72/7.6, 8.1, 8.2, 8.3, 8.9, 9.1, 11.1, 11.2, 11.6, 11.7, 12.7, 12.8, 229, 365.2

[56] References Cited

U.S. PATENT DOCUMENTS

| | | | |
|---|---|---|---|
| 4,745,556 | 5/1988 | Turley | 72/229 |
| 4,912,954 | 4/1990 | Vegter et al. | 72/9.2 |
| 5,054,302 | 10/1991 | Yamashita et al. | 72/365.2 |
| 5,609,053 | 3/1997 | Ferreira et al. | 72/11.8 |
| 5,797,288 | 8/1998 | Mas | 72/7.1 |

FOREIGN PATENT DOCUMENTS

| | | | |
|---|---|---|---|
| 4040360 | 6/1991 | Germany | 72/8.3 |
| 44 21 005 | 12/1995 | Germany . | |
| 57-137014 | 8/1982 | Japan . | |
| 62-234608 | 10/1987 | Japan . | |
| 1-78612 | 3/1989 | Japan . | |
| 5-138220 | 6/1993 | Japan . | |
| 7-246408 | 9/1995 | Japan . | |
| 8-24927 | 1/1996 | Japan . | |
| 1547898 | 3/1990 | U.S.S.R. | 72/8.3 |

OTHER PUBLICATIONS

1979, Ake Nilsson, "Automatic Flatness Control Systemfor Cold Rolling Mills", *Iron and Steel Engineer*, (Jun. 1979), pp. 55–60.

1984, Dr.–Ing. Bernd Berger et al., "Control of the Tensile Stress Distribution of Strip when Rolling Special Steel in a 20–roll Mill—Design of the Developed Control System", *Metallurgical Plant and Technology*, (Feb. 1984), p. 72 ff.

1984, Trevor J. Knox et al., "Installation and Operation of Automatic Shape Control on the BSC Llanwern 4–stand Tandem Mill", *Iron and Steel Engineer*, (Mar. 1984), pp. 31–38.

1986, Klaus Klamma, "Zukunftsorientierte Kaltwalztechnologie", *Neue Hütte*, (Oct. 1986), pp. 365–370. (English summary).

Jun. 1992, Arthur J. Carlton et al., "Automation of the LTV Steel Hennepin tandem cold mill" *Iron and Steel Engineer*, vol. 69, No. 6, pp. 20–28.

Jul. 1990/Aug. 1990, A. Serrano et al., "Preréglage automatique pour laminoirs réversibles" *Revue de Metallurgie*, vol. 87, No. 7/8, pp. 669–679.

Mar. 1998, Communication from the European Patent Office and attached Search Report.

*Primary Examiner*—Lowell A. Larson
*Assistant Examiner*—Ed Tolan
*Attorney, Agent, or Firm*—Merchant & Gould P.C.

[57] ABSTRACT

In a process for presetting the adjusting-member positions of a roll stand upon the rolling of a new coil or for the next pass in each case during cold rolling of bands, adjusting-member positions for the band flatness are used that are based on the corresponding actual data of the first pass of a reference coil, whose reference data results in the best correspondence with the target data of the new coil, or on the actual data of the preceding pass. At the same time, the band thickness can be preset by the specification of a rolling force or adjustment position adapted over a certain time period from the actual data of reference conditions of the roll stand or the rolling mill train.

15 Claims, 4 Drawing Sheets

Figure 1:
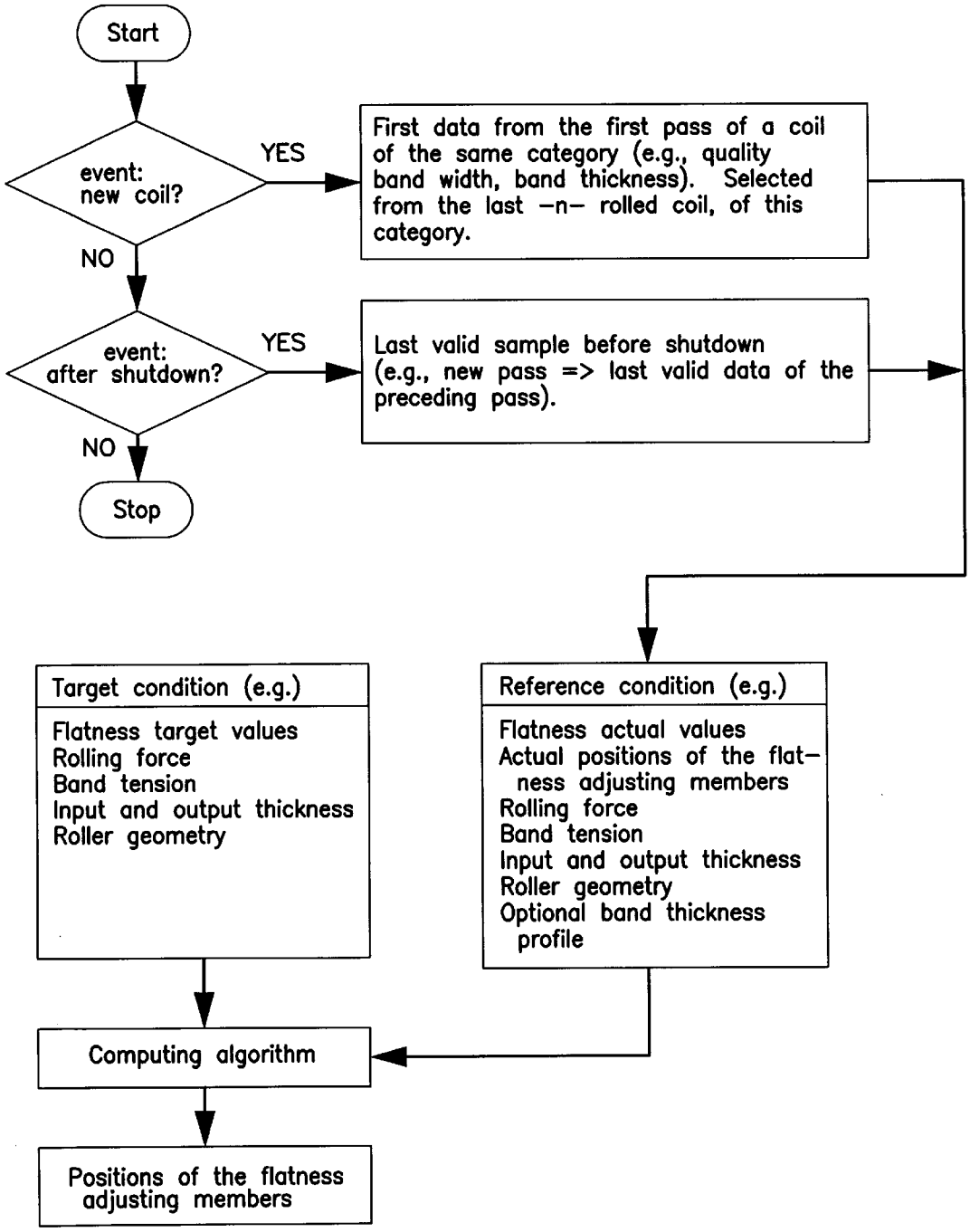

Table 1: Manner of proceeding with reference to a reference condition.

Table 1: Manner of proceeding with reference to a reference condition.

Table 2:
Determination of the new adjusting member positions with the help of an on−line computation of the roller gap with reference to a reference condition Table 3:
Determination of the new adjusting member positions with the aid of influence functions and influence factors that are calculated for the various flatness adjusting members as well as for the roller force by means of a pre-computation with a roller gap model.

Table 4:
Determination of the roller force or starting position which must be preset in order to achieve the target output thickness with consideration of the reference condition.

PRESETTING FOR COLD-ROLL REVERSAL STAND

The invention concerns a process for presetting the adjusting-member positions for band flatness in a reversal stand or rolling mill train for the first pass of a new coil during cold-rolling of bands, in particular of high-grade alloy steel. It concerns further a process for presetting the controlled adjusting-member positions for the band flatness with a reversal stand or a rolling mill train for restarting after a shutdown, for example upon a new pass or a roll change.

During cold-rolling of bands, especially high-grade alloy-steel bands, with improper adjustment of the roller-gap contour, longitudinal differences—so-called flatness defects—appear in the rolled band. If it is rolled with longitudinal tension, then these longitudinal differences lead to an unequal distribution of tension over the width of the band. The longitudinal or tensional differences can be highly variable.

For influencing the longitudinal or tensional distribution, different control processes were developed, which evaluate the tensional or longitudinal readings over the band width and accordingly activate the adjusting members, for example the roller bend of the rolling mill train. The German published application 44 21 005 describes a device for controlling the rolling, in particular the cold-rolling of high-grade alloy steel, in which are observed device deformation- and equipment-technology restrictions to the development, based on roller-technology measurements, of a frictionless course of operation and of a flawless rolled product.

Further control processes are described in the periodical "Iron and Steel Engineer", June 1979, pages 55 to 60, and March 1984, pages 31 to 38. In these control processes, only some of the measured tensional and longitudinal values at the band edge and band center are made use of for the calculation of the adjustment value. A further control process is described in "Neue Hütte" 1986, pages 365 to 370. In this process the tensional and longitudinal readings are approximated according to the error-squared method by means of an n-th degree polynomial. Finally, described in "Metallurgical Plant and Technology" 1984, pages 72 to 77 is an flatness-control process in which the adjusting members are adjusted jointly in such a manner that the ratio of the displacement remains constant even during the adjustment.

Application of the last-mentioned flatness-control process in the production of cold-rolled bands generally results in a good-quality band when the process runs its course in the steady-state rolling phase. This holds true for the band thickness, the mechanical characteristics, and the band flatness. The conditions are substantially less favorable in the non-steady-state phase, when the band is located in only a part of the stand of a rolling mill train, i.e. in the band threading phase, but also in the starting phase of each rolling pass. Up to now these phases have run their course largely without automatic control. They remain to a great degree subject to the intervention of the rolling-system operator, who, with a view to a particular band thickness and band flatness, sets among other things the following values: roller force, starting position, position of the adjusting members for influencing the roller gap, forward and backward tensile force, roller speed, and cooling-agent quantity.

With the fixing of the roller force, the rolling system is set with respect to a particular force to be applied to the band. With the fixing of the adjusting-member positions, the rolling system is set with respect to a particular geometry of the roller gap.

In this, the dimensional presetting is guided by the band measurements given at the beginning of each pass, i.e. the band thickness and width, by the particular working material, and by the cross-sectional reduction. The presetting of the reversal stand or of the rolling mill train by the rolling-system operator can deviate considerably from operational specifications. Beyond that, for the same rolling program considerable individual differences are possible in the setting of the rolling parameters in the starting phase of a rolling pass. The reason for this lies both in an overtaxing of the operator in consequence of the multiplicity of adjusting measures to be carried out, and in differing individual evaluations of the rolling events. It is thus inevitable that the band beginning and band end will differ in their geometric characteristics, mainly in band thickness and flatness, from the middle segment of the band rolled under steady-state conditions, and will therefore become scrap metal.

The presetting of the stand for the first pass causes special difficulties for both manual and automatic operation, since the thickness profile necessary thereto is known in very few cases.

The task forming the basis of the invention is to automate the presetting of the adjusting-member positions for band flatness required for a new coil as well as for a cold-rolled coil—after a roller shutdown and before the next pass or upon changing rollers. Beyond that, the presetting for band flatness of the particular roller stand should be possible for the first pass of a new coil even without knowledge of the warm-band band or thickness profile existing at the beginning of the pass.

The solution, in relation to a new coil, consists in the fact that, according to the invention, the actual corresponding data of the first pass of a reference coil selected from n previously-rolled coils are used as adjusting-member positions for the band flatness, the reference data of which coil, namely the stand-adjusting, band-flatness, and coil data, result in the best correspondence with the target data of the new coil, and that in each case an adjusting-member position is used that is formed from the data of the single actual reference condition plus an adjusting-member change dependent upon the difference between the data of the reference condition and that of the target condition. In this, n=1, 2, . . . holds good. The new coil is rolled on the basis of that historical set of data which possesses the greatest similarity in flatness to that of the target condition.

In relation to the pre-adjustment process during a restarting after a shutdown or between passes, as the case may be, the solution consists in the fact that an adjusting-member position for band flatness is used that is based on the corresponding actual data present immediately before the shutdown, and that in each case an adjusting-member position is used that is formed from the data of the single actual reference condition plus an adjusting-member change dependent upon the difference between the data of the reference condition and that of the target condition. This permits a consideration of the cold-hardening of the band that inevitably arises during each pass, the effect of which is exactly as if a different material were being rolled.

According to the invention, the adjusting members for the band flatness can be automatically preset. According to the invention, for the determination of the individual adjusting-member positions, reference is made to a reference condition with actual data from a preceding process or from the preceding process, as the case may be. For this, n previously rolled coils are considered, and the coil whose reference data comes closest to the target data of the new coil is used by way of comparison. As process data of the reference coil, the following are examples of possibilities in relation to the band flatness: roller force, band tension, input and output thickness, position of the flatness-adjustment members, and roller geometry.

According to the invention, knowledge of the thickness profile of the new coil is not necessary for determining the adjusting-member positions during the presetting of the adjusting members for band flatness. The gap between the rollers can adapt even to an unknown band profile. This is of great advantage, since during the cold rolling the band should retain the profile it had from the warm rolling; a change in profile would lead to waves in the band. When the band-thickness profile is known, however, it too can be taken into consideration during the determining of the adjusting-member positions.

The invention relates to an automatic system for the non-steady-state roller phase both with a new coil and after a shutdown. Within the scope of the invention, as reference data for the first pass of a new coil, the actual data from the beginning pass of the last n rolled coils can be taken from a data collection subdivided according to categories. Examples of the categories are: quality, band width, and band thickness.

As said above, in accordance with the invention, selected as reference coils for the rolling of a new coil are those previously-rolled coils whose stand-adjusting, band-flatness, and material data result in the best correspondence with the target condition of the new coil. Through this also ensues an automatic adapting to changes that appear during longer roller operation, for example through long-term changes of the warm-band thickness profile.

With the presetting according to the invention of the controlled adjusting-member positions both with a new coil and after a shutdown of the roller stand, in each case an adjusting-member position is used that is formed from the sum of the single actual reference condition and an adjusting-member change dependent upon the difference between the data of the reference condition and that of the target condition. In both cases the adjusting-member change is calculated from the data of the difference between the reference condition and the target condition. In other words, the new adjusting-member position results from the earlier adjusting-member position of the reference condition plus a separately determined adjusting-member change. The latter can be determined either by the use of a roller-gap model, or the influence functions of the flatness-adjusting members and the influence of the roller force are ascertained beforehand with a roller-gap model. This ascertaining beforehand can, within the scope of the invention, also take place in combination with a process parameter-setting, or alone through a process parameter-setting. In a process parameter-setting, the parameters of an empirical algorithm are determined through trials carried out on the stand used for the respective application.

The invention concerns further a process for presetting the band thickness with reversal stand or a rolling mill train for a new coil or the next pass in each case of a rolled coil during cold-rolling of bands, in particular of high-grade alloy steel. This process is based on the problem of automating the required adjusting-member positions for band thickness at the beginning of each pass. At the beginning of the pass, the rolling stand should be automatically set for a band thickness that is exactly maintained during the steady state phase. Preferably, the band-thickness presetting of the respective rolling stand should be possible for the first pass of a new coil even without knowledge of the band or thickness profile of the warm band.

For the presetting of the band thickness, the solution within the scope of the invention consists preferably in presetting the band thickness through the fixing of a roller force or starting position that is adapted over a certain time period from the actual data of reference conditions of the rolling stand in question.

Accordingly, the band thickness is preferably preset via the fixing of a predetermined roller force or via the fixing of a predetermined starting position. In this, the production curves for determining the specified data should be adapted over a certain preceding time period from the actual process data for the rolling stand in question. By this means the following is achieved, that even with a still-unknown thickness profile of the band, the band thickness is set automatically and practically immediately at the beginning of the pass, which band thickness is also rolled in the steady state region. Due to the automatic system, time-consuming start-up procedures are omitted and process interruptions such as torn bands are practically excluded. In the preferred process for presetting the band thickness before a new pass, during the transition from pass n to pass n+1 (n=0, 1, 2 . . . not only is—as usual—a smaller gap set between the rollers, but also the other characteristic values of the rolling stand are changed in such a manner that the band becomes thinner while relative thickness profile remains unchanged. Thus, rolling thicknesses, or rather roller-gap widths, are preferably set automatically at the beginning of the pass and are maintained during the further course of the rolling.

By the aid of the schematic representation in the attached flow charts, individual details of the invention will be explained. The charts show:

FIG. 1: The manner of proceeding with reference to a reference condition during presetting of the band flatness.

Figure 2:
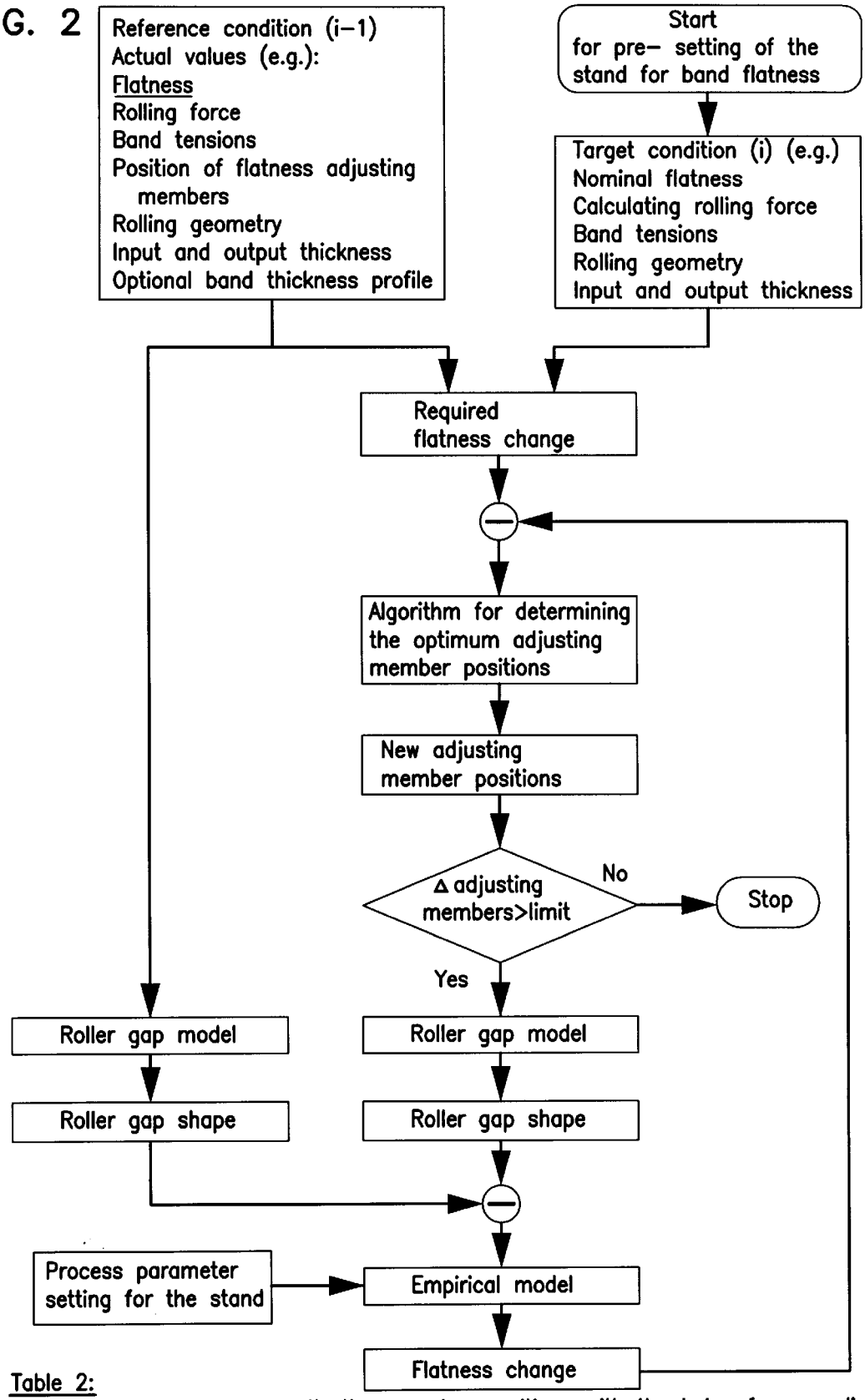

FIG. 2: Determination of the new adjusting-member positions for the band flatness, with the aid of an on-line computation of the roller gap, with a view to the reference condition.

Figure 3:
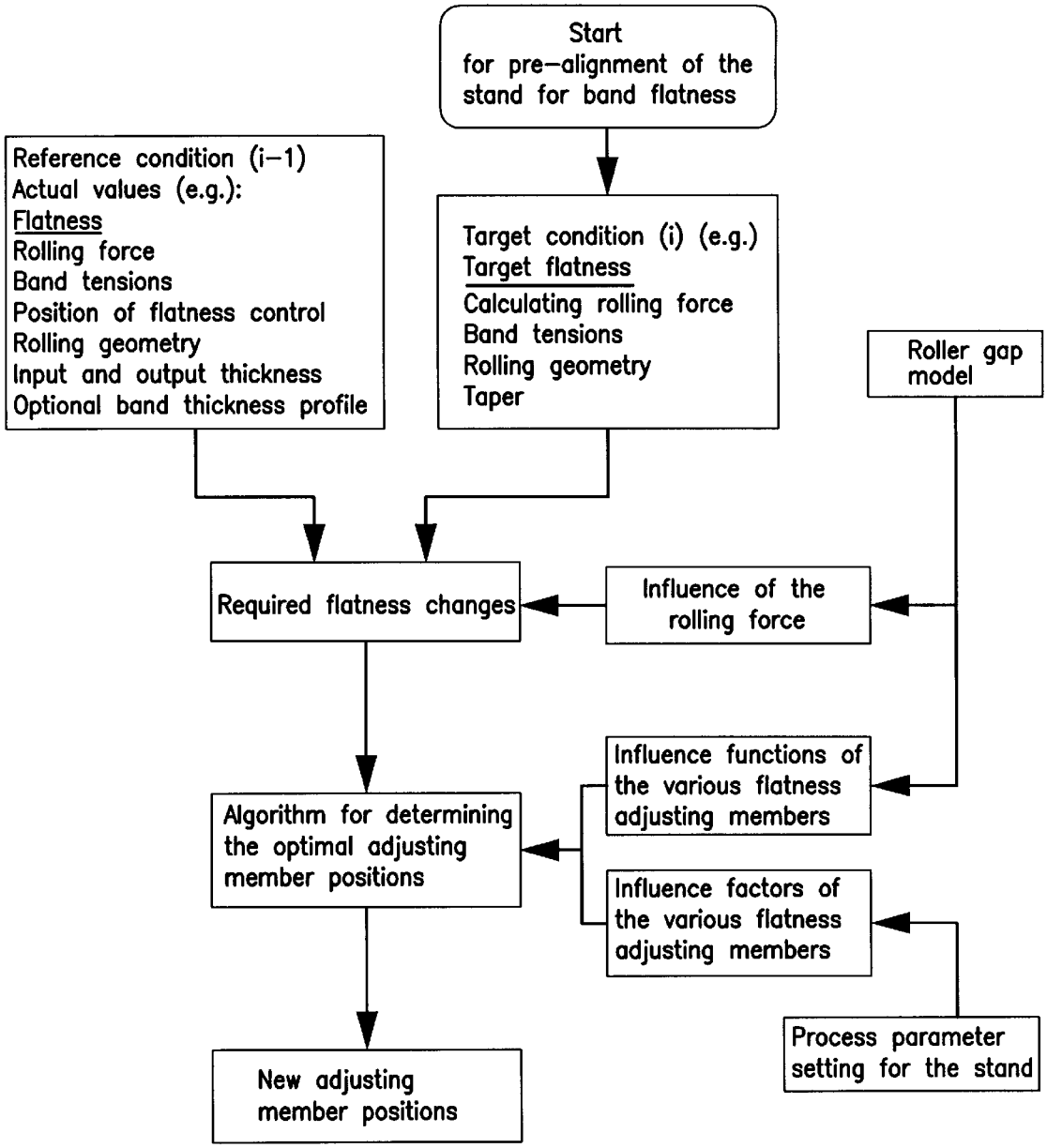

FIG. 3: Determination of the new adjusting-member positions with the aid of influence functions and influence factors, which are determined for the different flatness-adjusting members as well as for the roller force by means of an advance ascertaining with a roller-gap model.

Figure 4:
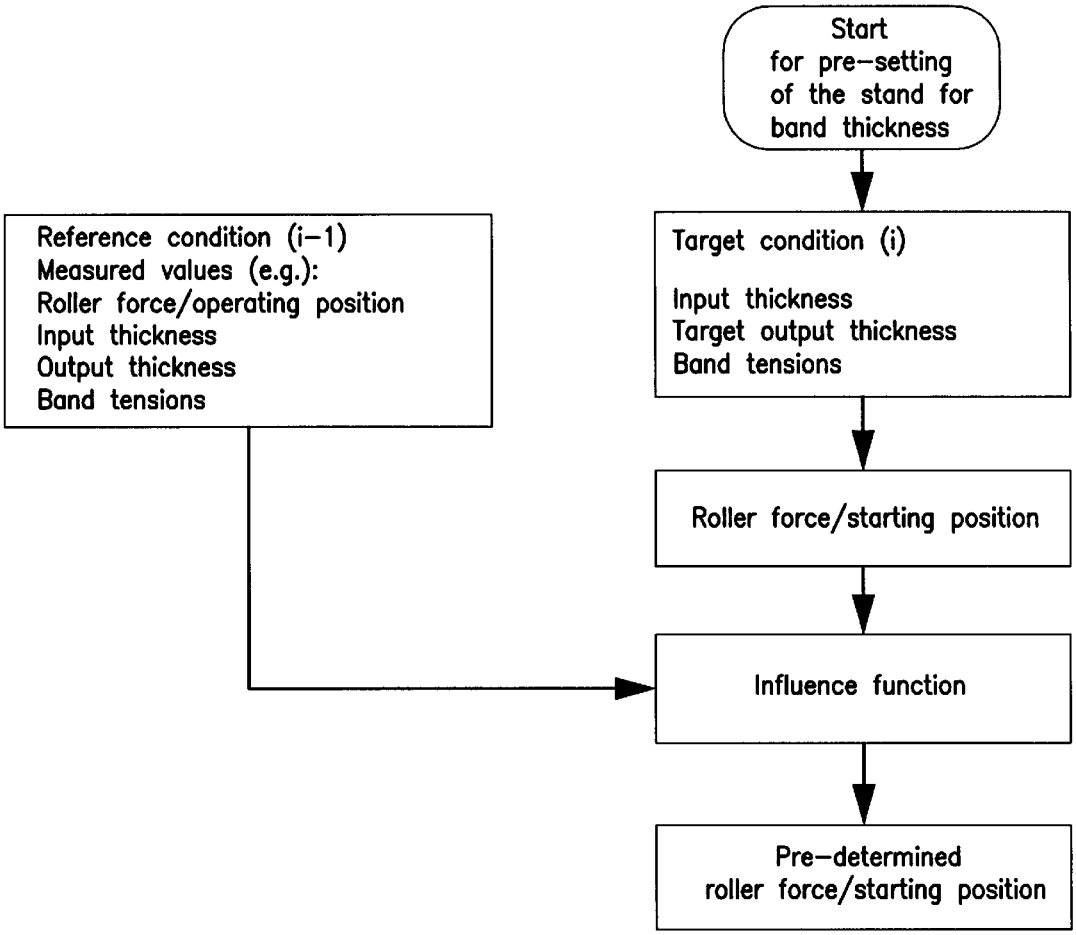

FIG. 4: Determination of the roller force or startup position for a desired band thickness.

In chart 1 the reference condition is distinguished for the different events, namely for the rolling of a new coil or for a restarting after a shutdown of the rolling stand. In the first case, serving as the reference data for the first pass of the new coil is the actual data from the first pass of a coil of the same category, for example quality, band width, and band thickness, which coil is selected from the last n rolled coils. In the other case, after a shutdown, for example with each new pass or upon a roller change, serving as the reference data is the actual data that was obtained immediately prior to the shutdown with the same coil. The reference condition thus determined (the individual values or examples of values are given in chart 1), together with the ideal condition (the individual data for this are also given in chart 1), is inputted to a computing algorithm, which supplies the adjusting-member positions for the band flatness.

The adjusting-member positions according to the invention are determined in accordance with the flow charts in charts 2 and 3, which positions are a function of the adjusting-member positions of the reference condition plus the calculated adjusting-member change. The calculation takes place on-line by application of a roller-gap model, in accordance with chart 2. The calculation of the new adjusting-member position should take place iteratively. The iteration is ended when the difference between the adjusting-member positions of the iteration step of present interest and the preceding step falls below a certain pregiven limiting value. This limiting value is adapted to the precision of positioning of the adjusting member.

According to chart 3, the influence functions of the flatness-adjusting members and the influence of the rolling force are determined beforehand with the aid of the roller-gap model. The individual details of the sequential operations are shown in an easily surveyed manner in charts 2 and 3.

Chart 4 illustrates an implementation scheme of the process to determine the rolling force or starting position, as the case may be, to be preset for the purpose of achieving the desired ideal output thickness, with a view to a reference condition. The target condition is defined by: the input thickness of the band, the ideal output thickness, and the band tension. To achieve the target, the values of the reference condition are altered—preferably on-line—by means of an influence function dependent on the measured values of the reference condition, for example, rolling force/starting position, input thickness, output thickness, and band tension. The result is the rolling force or starting position to be preset, with which the band is automatically rolled at each new pass, including the first pass.

We claim:

1. A process for presetting adjusting-member position of a reversal stand or a rolling mill train for a first pass of a new coil during cold rolling of a band, comprising:

a) comparing target data for the new coil with a plurality of reference data which are actual data of previously-rolled coils, and selecting an adjusting-member position based on reference data having closest correspondence to the target data;

b) determining an adjusting member change based on the difference between the reference data and the target data, and obtaining a new adjusting member position from the adjusting-member position of the reference data and the adjusting member change;

c) replacing the reference data based on the new adjusting-member position to establish new reference data;

d) repeating steps b) and c) until a difference between the new reference data and the previous reference data is below a limit value.

2. A process as claimed in claim 1, wherein the adjusting member change is determined based on a roller-gap model or a process-parameter setting.

3. A process as claimed in claim 2, wherein influences of flatness data and rolling force of the new adjusting-member position are determined based on the roller-gap model or the process-parameter setting.

4. A process as claimed in claim 2, wherein the band thickness setting of the reversal stand or the rolling mill train is preset by means of specifying a roller force or a starting position adapted over a certain time period with consideration of the reference data of the reversal stand or the rolling mill train.

5. A process as claimed in claim 1, wherein influences of flatness data and rolling force of the new adjusting-member position are determined based on a roller-gap model or a process-parameter setting.

6. A process as claimed in claim 5, wherein the band thickness setting of the reversal stand or the rolling mill train is preset by means of specifying a roller force or a starting position adapted over a certain time period with consideration of the reference data of the reversal stand or the rolling mill train.

7. A process as claimed in claim 1, wherein the band thickness setting of the reversal stand or the rolling mill train is preset by means of specifying a roller force or a starting position adapted over a certain time period with consideration of the reference data of the reversal stand or the rolling mill train.

8. A process as claimed in claim 7, wherein the reference data include rolling force, starting position, input thickness, output thickness, and band tension.

9. A process as claimed in claim 1, wherein the band is a high-grade alloy steel.

10. A process for presetting adjusting-member position of a reversal stand or a rolling mill train for a re-starting after a shutdown during cold-rolling of a band, comprising:

a) using reference data as a first adjusting-member position, wherein the reference data are the data obtained immediately before the shutdown;

b) determining an adjusting member change based on the difference between the reference data and target data, and obtaining a new adjusting member position from the adjusting-member position of the reference data and the adjusting member change;

c) replacing the reference data based on the new adjusting-member position to establish new reference data;

d) repeating steps b) and c) until a difference between the new reference data and the previous reference data is below a limit value.

11. A process as claimed in claim 10, wherein the adjusting-member change is determined based on a roller-gap model or a process-parameter setting.

12. A process as claimed in claim 10, wherein influence of flatness data and rolling force of the new adjusting-member position are determined based on a roller-gap model or a process-parameter setting.

13. A process as claimed in claim 10, wherein the band thickness setting of the reversal stand or the rolling mill train is preset by means of specifying a roller force or a starting position adapted over a certain time period with consideration of the reference data of the reversal stand or the rolling mill train.

14. A process as claimed in claim 10, wherein the reference data include rolling force, starting position, input thickness, output thickness, and band tension.

15. A process as claimed in claim 10, wherein the band is a high-grade alloy steel.

* * * * *